US007409982B2

(12) United States Patent
Newcomb

(10) Patent No.: US 7,409,982 B2
(45) Date of Patent: Aug. 12, 2008

(54) FOUNDRY MOLD ASSEMBLY DEVICE AND METHOD

(75) Inventor: Thomas P. Newcomb, Defiance, OH (US)

(73) Assignee: GM Global Technology Operations, Inc., Detroit, MI (US)

( * ) Notice: Subject to any disclaimer, the term of this patent is extended or adjusted under 35 U.S.C. 154(b) by 402 days.

(21) Appl. No.: 11/208,095

(22) Filed: Aug. 19, 2005

(65) Prior Publication Data

US 2007/0039710 A1 Feb. 22, 2007

(51) Int. Cl.
*B22D 19/08* (2006.01)
*B22D 27/02* (2006.01)

(52) U.S. Cl. ..... 164/332; 164/333; 164/148.1

(58) Field of Classification Search ..... 164/498, 164/148.1, 98, 112, 332–334
See application file for complete search history.

(56) References Cited

U.S. PATENT DOCUMENTS 3,608,615 A * 9/1971 Conlon ..... 164/479
5,365,997 A 11/1994 Helgesen et al.
5,524,696 A * 6/1996 Osborne et al. ..... 164/34
5,730,200 A 3/1998 Landua

* cited by examiner

*Primary Examiner*—Kuang Lin

(57) ABSTRACT

A mold assembly device for use in sand casting of engine cylinder blocks is disclosed, the mold assembly device includes a magnet for securing a cast-in-place cylinder bore liner during assembly of a mold package, wherein the magnet militates against undesirable movement of the bore liner during assembly of the mold package.

12 Claims, 4 Drawing Sheets

FOUNDRY MOLD ASSEMBLY DEVICE AND METHOD

FIELD OF THE INVENTION

The invention relates to a mold assembly device and more particularly to a mold assembly device for use in sand casting of engine cylinder blocks, the device including a magnet for securing a cast-in-place cylinder bore liner during assembly of a mold package.

BACKGROUND OF THE INVENTION

In a sand casting process for an aluminum internal combustion engine block, an expendable mold package is assembled from a plurality of resin-bonded sand cores that define the internal and external surfaces of the engine block. Typically, each of the sand cores is formed by blowing resin-coated foundry sand into a core box and curing it therein. Cast-in-place bore liners are often used in such castings.

Typically, in the manufacture of an aluminum engine block with cast-in-place bore liners, the mold assembly method involves positioning a base core on a suitable surface and building up or stacking separate mold elements to shape such casting features as the sides, ends, water jacket, cam openings, and crankcase. The bore liners are positioned on barrel core features such that the liners become embedded in the casting after the metal is poured into the mold. Additional cores may be present as well depending on the engine design. Various designs for the barrel cores are used in the industry. These include individual barrel cores, "V" pairs of barrel cores, barrel-slab cores, and integral barrel crankcase cores. The barrel-slab and integral barrel crankcase designs are often preferred because they provide more accurate positioning of the liners within the mold assembly.

The engine block casting must be machined in a manner to ensure, among other things, that the cylinder bores (formed from the bore liners positioned on the barrel features of the barrel cores) have uniform bore liner wall thickness, and that other critical block features are accurately machined. This requires the liners to be accurately positioned relative to one another within the casting. The ease and consistency with which the bore liners are brought into the desired final position during the mold assembly process is an important consideration.

In barrel slab cores, the bore liners are positioned on the barrel core features by slidingly placing the bore liners on the barrel core features. Alternatively, the liners may be placed into the core tooling and the core sand blown into the liners to form the barrel core feature. Prior to casting, the barrel-slab cores are inverted for assembly into the mold package. Undesirable movement of the bore liners relative to the slab core may occur while the assembly is inverted.

One attempt to resolve the issues described above is disclosed in U.S. Pat. No. 5,365,997. In the '997 patent, an internal diameter chamfer is incorporated into the cylinder bore liner design to militate against undesirable displacement of the cylinder bore liner. Another attempt to resolve the issues described above is disclosed in U.S. Pat. No. 5,730,200. In the '200 patent, an expanding mandrel is used inside of a hollow barrel core to secure the cylinder bore liner to the barrel core during assembly of the mold package.

It would be desirable to produce a mold assembly device which secures a cast-in-place cylinder bore liner for use in sand casting of engine cylinder blocks during assembly of a mold package, wherein the mold assembly device militates against undesirable movement of the bore liner during assembly of the mold package.

SUMMARY OF THE INVENTION

Consistent and consonant with the present invention, a mold assembly device which secures a cast-in-place cylinder bore liner for use in sand casting of engine cylinder blocks during assembly of a mold package, wherein the mold assembly device militates against undesirable movement of the bore liner during assembly of the mold package, has surprisingly been discovered.

In one embodiment, the mold assembly device comprises a handling fixture adapted to be releasably connected to a barrel slab core; and means for producing a magnetic field to attract a cylinder bore liner disposed on a barrel core feature of the barrel slab core toward an inner surface of the barrel slab core.

In another embodiment, the mold assembly device comprises a handling, fixture releasably connected to a barrel slab core, the barrel slab core having an inner surface, an outer surface, and a plurality of barrel core features extending outwardly from the inner surface, each of the barrel core features having a cylinder bore liner disposed thereon; and at least one magnet disposed between the handling fixture and the barrel slab core, the at least one magnet attracting the cylinder bore liner of each barrel core feature toward the inner surface of the barrel slab core.

The invention also provides methods of assembling a mold package.

In one embodiment, the method of assembling a mold package comprises the steps of providing a barrel slab core having an inner surface, an outer surface, and a plurality of barrel core features extending outwardly from the inner surface; positioning a cylinder bore liner on each of the barrel core features of the barrel slab core; providing a handling fixture adapted to be releasably connected to the barrel slab core; providing at least one magnet; and positioning the at least one magnet between the barrel slab core and the handling fixture, wherein a magnetic field produced by the magnet attracts the cylinder bore liner of each barrel core feature toward the inner surface of the barrel slab core to militate against movement of the cylinder bore liner during assembly of the barrel slab core in a mold package.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate an exemplary embodiment of the invention. The description and drawings serve to enable one skilled in the art to make and use the invention, and are not intended to limit the scope of the invention in any manner. For purposes of illustration, and not limitation, a mold package for a six-cylinder V-type engine is shown. It is understood that the invention can be used with mold packages for engines having more or fewer cylinders and different cylinder configurations if desired.

Figure 1:
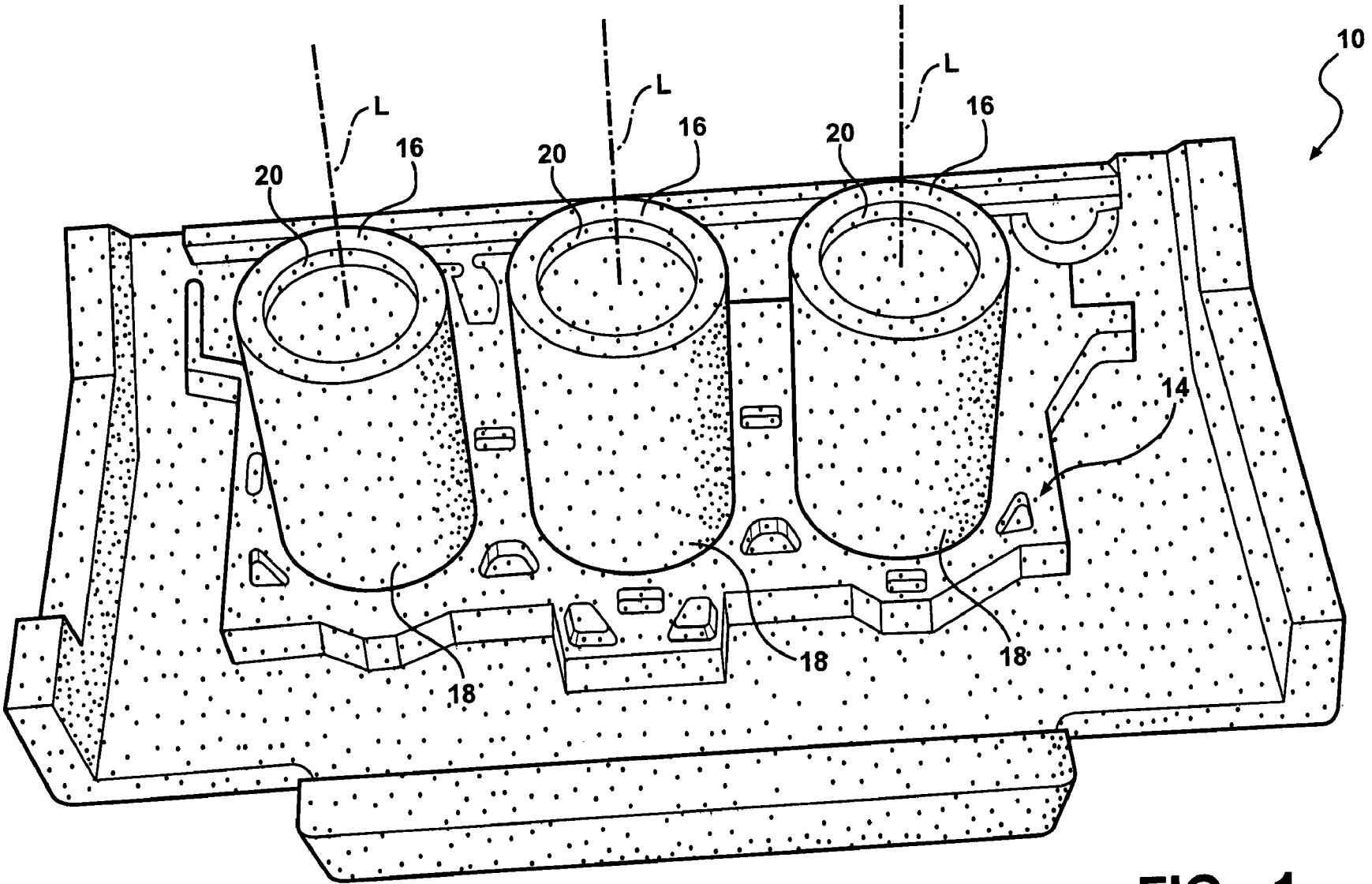
FIG. 1 is a perspective view of a barrel slab core including three barrel core features.
Figure 4:
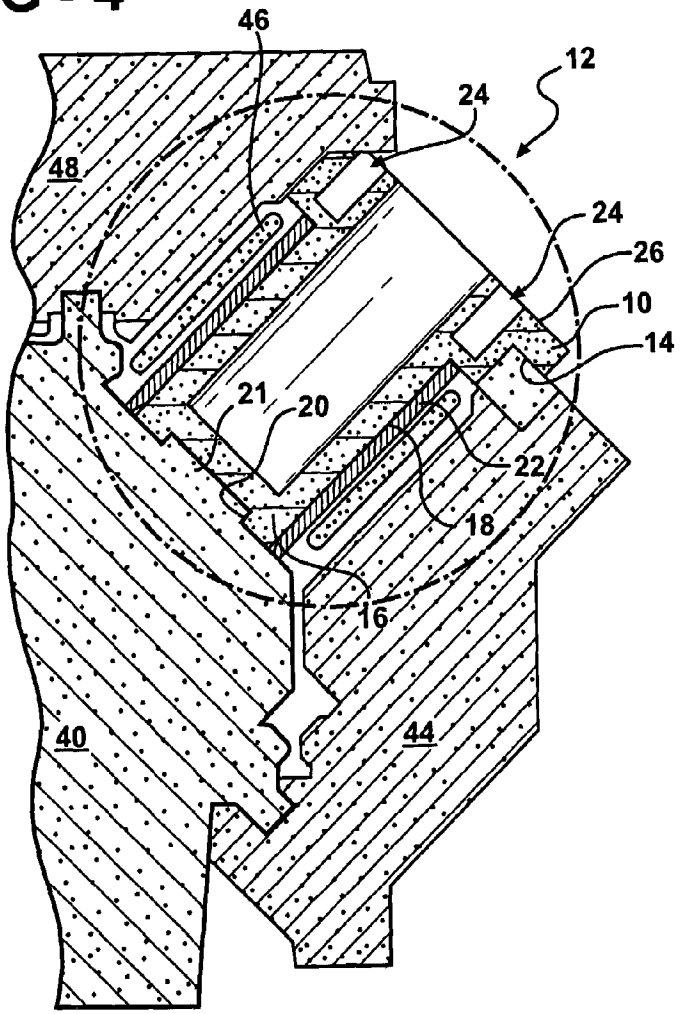
FIG. 4 is a partial sectional view of a cylinder block mold package for forming an engine block casting after installation of the barrel slab core.

FIG. 1 depicts a barrel slab core 10 adapted to be assembled with additional mold cores such as a base core and a crankcase core, for example, to form a cylinder block mold package 12 as shown in FIG. 4. A typical cylinder block mold package is shown and described in commonly owned U.S. Pat. No. 6,615,901 B2, hereby incorporated herein by reference. It should be noted that the mold package shown and described in the '901 patent includes an integral barrel crankcase core (IBCC), whereas the embodiment of the invention shown and described herein includes a barrel slab core having barrel core features disposed thereon.

In the embodiment shown, the barrel slab core 10 is produced from resin bonded sand. The resin bonded sand cores can be made using conventional core-making processes such as a phenolic urethane cold box or Furan hot box where a mixture of foundry sand and resin binder is blown into a core box and the binder cured with either a catalyst gas or heat, respectively. The foundry sand can comprise silica, zircon, fused silica, and others. An inner surface 14 of the barrel slab core 10 defines a portion of an outer surface of an engine block (not shown) after casting.

Barrel core features 16 having an outer surface 18 extend outwardly from the inner surface 14 of the barrel slab core 10 and terminate at a free end. The barrel core features 16 are slightly tapered cylinders. The barrel core features 16 are disposed in a row with a common plane passing through a longitudinal axis L of each of the barrel cores 16 to form a linear array of barrel core features 16. A core print 20 is formed in the free end of each of the barrel core features 16. In the embodiment shown, the core prints 20 have a substantially circular cross section. However, it is understood that other cross sectional shapes could be used. The core prints 20 are adapted to mate with corresponding core prints 21, illustrated in FIG. 4, formed upon a crankcase core 40 to promote proper assembly of the cylinder block mold package 12. Other shapes and configurations of core prints can be used as desired. Additionally, although female core prints are shown, it is understood that male core prints can be used.

Figure 2:
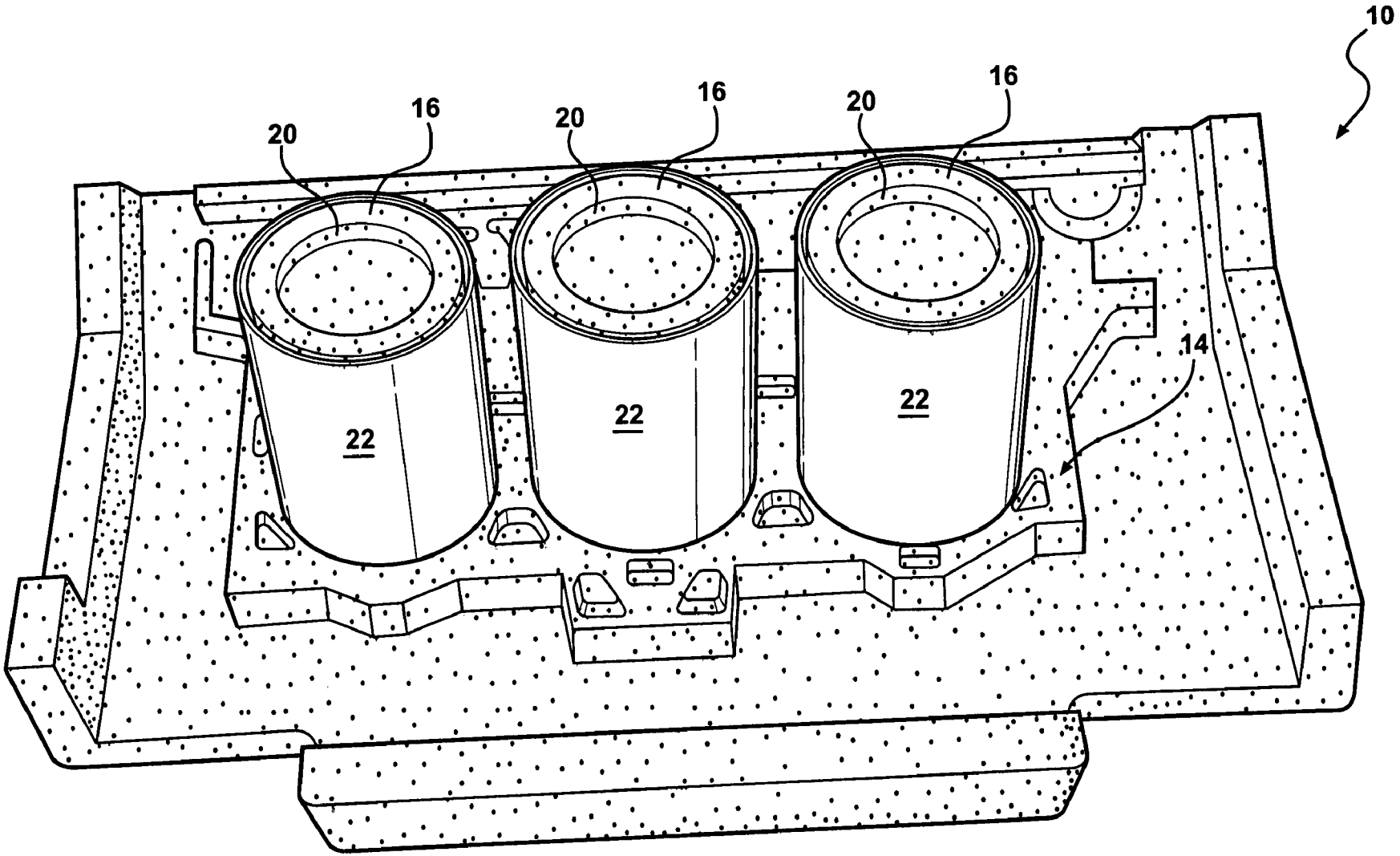
FIG. 2 is a perspective view of the barrel slab core of FIG. 1 including a cylinder bore liner disposed on each of the barrel core features.

FIG. 2 shows the barrel slab core 10 illustrated in FIG. 1 including a metal cylinder bore liner 22 disposed on each of the barrel core features 16. The cylinder bore liners 22 have a hollow interior with a substantially uniform diameter adapted to receive the barrel core features 16 therein. The bore liners 22 form a cylinder wall for each cylinder of the cast engine block. The cylinder bore liners 22 can be produced by machining or casting a ferrous material. Typically, the cylinder bore liners 22 are used in an aluminum engine block and the cylinder bore liners 22 are formed of cast iron. However, it is understood that other magnetic materials can be used for the bore liners 22 and other materials can be used for the engine block as desired.

Figure 3:
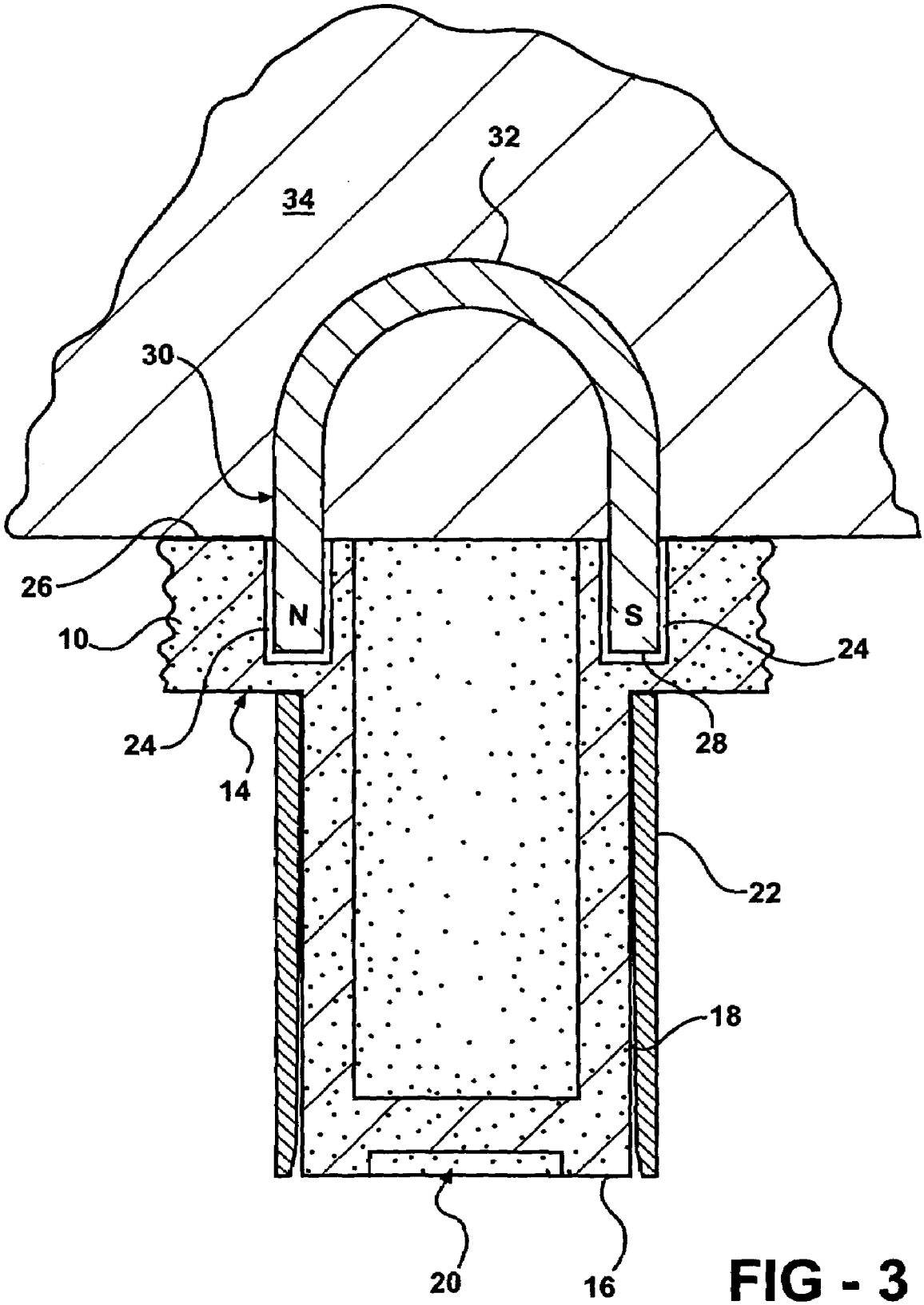
FIG. 3 is a sectional view of a single barrel core feature and a bore liner during installation of the barrel slab core in an engine block mold package according to an embodiment of the invention.

In FIG. 3, a single barrel core feature 16 and a cylinder bore liner 22 of the barrel slab core 10 are shown inverted from the position shown in FIGS. 1 and 2, and prior to assembly in the cylinder block mold package 12. Note that it is not necessary to fully invert the barrel slab core 10 for assembly into the cylinder block mold package 12. Apertures 24 are formed in the barrel slab core 10 on an outer surface 26 thereof adjacent an end of the cylinder bore liner 22. A first end 28 of a u-shaped magnet 30 is disposed in the apertures 24. Any conventional magnet can be used such as a rare earth permanent magnet or an electromagnet, for example. Additionally, although a single magnet 30 is shown, it is understood that a plurality of magnets can be used if desired. It is further understood that an intermediate article of suitable construction, shape, and material may be imposed between the magnet 30 and the barrel slab core 10, extending into the apertures 24, for the purpose of conducting the magnetic field. Any conventional magnet shape can be used.

A second end 32 of the magnet 30 is joined with a handling fixture 34. As used herein, the handling fixture 34 means an assembly device, a robotic end-effector, and the like, which can be manual or automatic. The handling fixture 34 is used in the art to assist in assembly and positioning of the barrel slab core 10 in the cylinder block mold package 12. The handling fixture 34 is releasably connected to the barrel slab core 10. Any conventional means of releasable connection such as opposed articulating grip pads or expanding mandrels inserted into female features of the barrel slab core 10, for example, can be used as desired.

Figure 5:
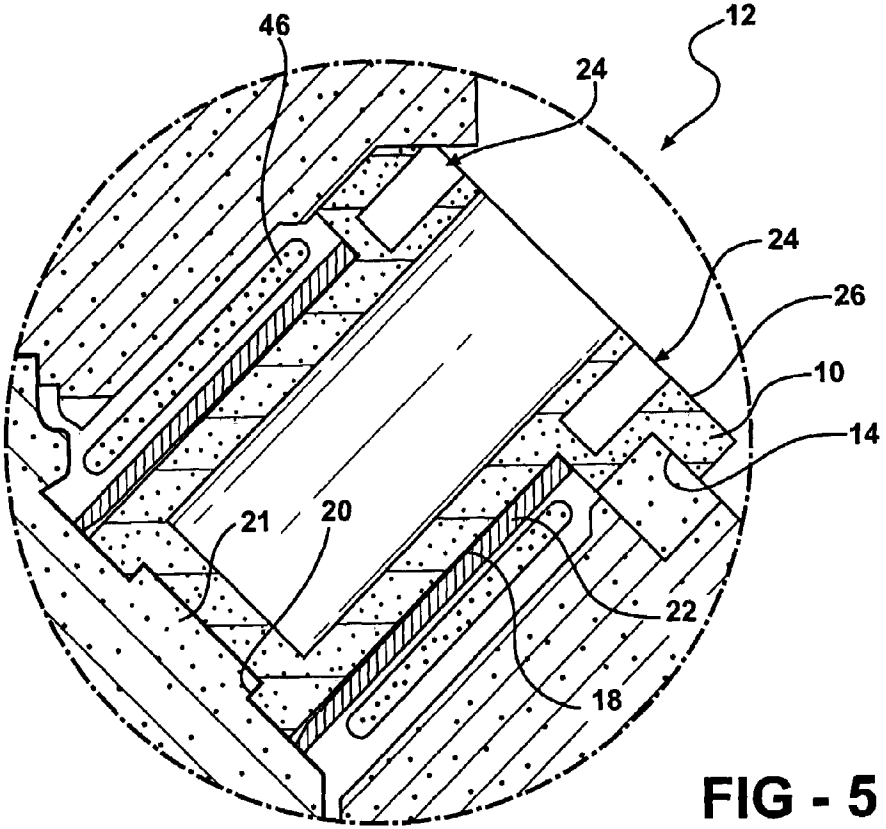
FIG. 5 is an enlarged partial sectional view of the cylinder bore liner and the barrel core feature of the cylinder block mold package illustrated in FIG. 4.

FIG. 4 illustrates a partial view of the cylinder block mold package 12. The cylinder block mold package 12 includes a crankcase core 40 having a side core 44 disposed adjacent thereto. A water jacket core 46 is disposed adjacent and between the barrel core features 16 of the barrel slab core 10. A valley core 48 is disposed between corresponding barrel slab cores 10. Additional cores may be included as desired such as a base core (not shown). FIG. 5 shows an enlarged view of the cylinder bore liner 22 and the barrel core feature 16 of the cylinder block mold package 12 in FIG. 4. Note that the cylinder bore liner 22 is seated against the crankcase core 40. It is also understood that the present invention can be used in configurations where the cylinder bore liner 22 is not seated against the crankcase core 40.

Assembly of the barrel slab core 10 including the cylinder bore liners 22 with the cylinder block mold package 12 will now be described. The steps of the process are intended to be exemplary in nature, and thus, the order of the steps is not necessary or critical. The barrel slab core 10 is formed according to methods well known in the art. Once formed, the barrel slab core 10 is placed in the position shown in FIG. 1. One of the cylinder bore liners 22 is placed on each of the barrel core features 16 of the barrel slab core 10. The barrel slab core 10 is then ready for assembly with the cylinder block mold package 12.

In order to assemble the barrel slab core 10 in the cylinder block mold package 12, the barrel slab core 10 must be inverted from the position shown in FIGS. 1 and 2. However, the cylinder bore liners 22 are susceptible to shifting or sliding off of the barrel core features 16 in the inverted position. In order to counteract this tendency, the magnet 30 is inserted into the apertures 24 formed in the barrel slab core 10. This places the magnet 30 sufficiently close to the cylinder bore liner 22 for the cylinder bore liner 22 to be affected by the magnetic field produced by the magnet 30. The magnetic field attracts the cylinder bore liner 22 toward the inner surface 14 of the barrel slab core 10. This militates against movement of the cylinder bore liner 22 such as shifting or sliding off of the barrel core feature 16. Additionally, the cylinder bore liner 22 is brought into contact with the inner surface 14 of the barrel slab core 10 resulting in the cylinder bore liner 22 being squared against the inner surface 14. This encourages proper concentric positioning of the cylinder bore liner 22 for assembly into the cylinder block mold package 12.

It is understood that the apertures 24 could be omitted if the magnetic field produced by the magnet 30 is sufficiently strong to affect the cylinder bore liner 22 while positioned adjacent the outer surface 26 of the barrel slab core 10. Conversely, the apertures 24 may penetrate the entire thickness of barrel slab core 10 if desired. In the embodiment shown, the magnet 30 is held by the handling fixture 34. When the handling fixture 34 is connected to the barrel slab core 10, the magnet 30 is positioned adjacent the cylinder bore liner 22. It is understood that the magnet 30 can be brought into position using other means without departing from the scope and spirit of the invention.

The joined barrel slab core 10, magnet 30, and handling fixture 34 are then inverted for assembly with the cylinder block mold package 12. The barrel slab core 10 is then assembled with the cylinder block mold package 12. Once the barrel slab core 10 is positioned as desired in the cylinder block mold package 12, the handling fixture 34 is released from the barrel slab core 10 and initially withdrawn from the barrel slab core 10 in a direction parallel to the centerline of the cylinder bore liner 22. Movement of the magnet 30 away from the cylinder bore liner 22 with the handling fixture 34 releases the cylinder bore liner 22 from the magnetic field produced by the magnet 30. Further assembly of the cylinder block mold package 12 and casting of the engine block can now be accomplished. Alternatively, the magnet 30 can be withdrawn from the apertures 24 before the release of the handling fixture 34 from the barrel slab core 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A mold assembly device comprising:

a handling fixture adapted to be releasably connected to a barrel slab core; and means for producing a magnetic field to attract a cylinder bore liner disposed on a barrel core feature of the barrel slab core toward an inner surface of the barrel slab core.

2. The device according to claim 1, wherein the means for producing a magnetic field is a magnet disposed between said handling fixture and the barrel slab core.

3. The device according to claim 2, wherein the magnet is adapted to be disposed in an aperture formed in the barrel slab core.

4. The device according to claim 2, wherein the magnet is attached to said handling fixture.

5. The device according to claim 2, wherein the magnet is an electromagnet.

6. The device according to claim 2, wherein the magnet is a rare earth permanent magnet.

7. A mold assembly device for sand casting of engine cylinder blocks comprising:

a handling fixture releasably connected to a barrel slab core, the barrel slab core having an inner surface, an outer surface, and a plurality of barrel core features extending outwardly from the inner surface, each of the barrel core features having a cylinder bore liner disposed thereon; and at least one magnet disposed between said handling fixture and the barrel slab core, said at least one magnet attracting the cylinder bore liner of each barrel core feature toward the inner surface of the barrel slab core.

8. The device according to claim 7, wherein said at least one magnet is adapted to be disposed in an aperture formed in the barrel slab core.

9. The device according to claim 7, wherein said at least one magnet is attached to said handling fixture.

10. The device according to claim 7, wherein said at least one magnet is an electromagnet.

11. The device according to claim 7, wherein said at least one magnet is a rare earth permanent magnet.

12. The device according to claim 7, wherein said at least one magnet is U-shaped.

* * * * *